United States Patent [19]

Simm et al.

[11] 4,265,996

[45] May 5, 1981

[54] METHOD OF IMPROVING THE ELECTRICAL CONTACT BETWEEN THE INSULATING IMAGE CARRIER AND CONDUCTIVE SUPPORT IN ELECTROGRAPHIC RECORDING PROCESSES

[75] Inventors: Walter Simm, Leverkusen; Friedrich Bestenreiner, Gruenwald, both of Fed. Rep. of Germany

[73] Assignee: Agfa-Gevaert Aktiengesellschaft, Leverkusen, Fed. Rep. of Germany

[21] Appl. No.: 801,460

[22] Filed: May 31, 1977

[30] Foreign Application Priority Data

Jun. 5, 1976 [DE] Fed. Rep. of Germany ..... 2625395

[51] Int. Cl.[3] ..... G03G 13/10

[52] U.S. Cl. ..... 430/119; 118/650; 118/659; 118/660; 430/103; 430/902

[58] Field of Search ..... 96/1 LY, 1 R, 1 SD, 96/1 C; 250/326; 118/650, 659, 660; 430/119, 117, 103, 902; 34/156, 122

[56] References Cited

U.S. PATENT DOCUMENTS

| | | | |
|---|---|---|---|
| 2,922,883 | 1/1960 | Giaimo | 96/1 C |
| 3,470,417 | 9/1969 | Gibbons | 250/326 X |
| 3,651,323 | 3/1972 | Tanaka et al. | 96/1 C |
| 3,877,963 | 4/1975 | Sato | 96/1 LY |
| 4,043,052 | 8/1977 | Honjo et al. | 96/1 LY |

FOREIGN PATENT DOCUMENTS

| | | | |
|---|---|---|---|
| 1397650 | 6/1975 | United Kingdom | 96/1 LY |

*Primary Examiner*—Roland E. Martin, Jr.
*Assistant Examiner*—John Goodrow

[57] ABSTRACT

For improving the electrical contact between an insulating image carrier and a conductive support during development of an electrostatic charge image in electrographic recording processes a gas permeable support is used through which gas ions are brought to the back of the carrier while development takes place on the image side.

5 Claims, 3 Drawing Figures

Figure 1:
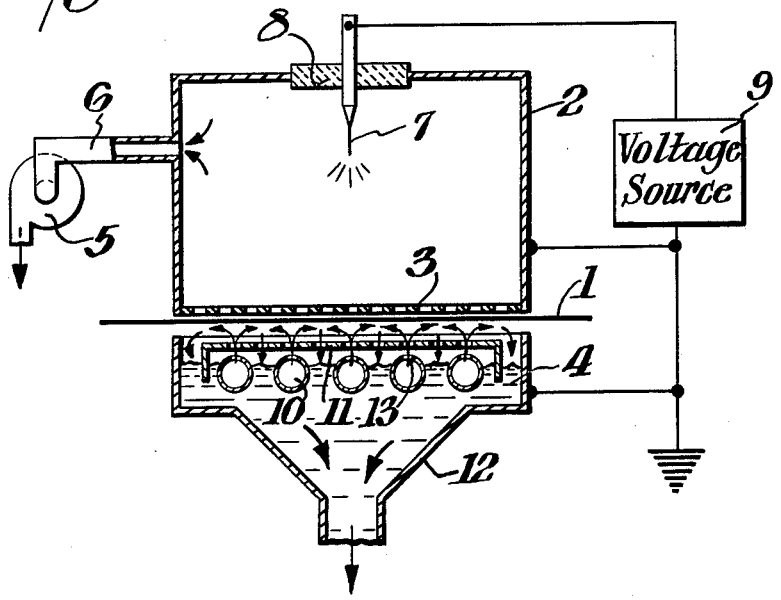

METHOD OF IMPROVING THE ELECTRICAL CONTACT BETWEEN THE INSULATING IMAGE CARRIER AND CONDUCTIVE SUPPORT IN ELECTROGRAPHIC RECORDING PROCESSES

This invention relates to a method of providing improved electrical contact between an insulating image carrier and a conductive support during development of an electrostatic charge image in electrographic recording processes.

The development of electrostatic charge images in electrophotography and electrography by the deposition of charged pigment particles on the surface of the recording carrier is already known. The electrostatic charge image is generally produced on a recorded carrier consisting of two layers, namely, a highly insulating layer and a conductive layer.

Completely new problems arise in the development of images in electrographic recording processes in which the recording or image carrier consists solely of a highly insulating film and not a double layer. Recording processes of this kind have been described, for example, in British Patent Specifications No. 1,285,995, and No. 1,397,650 and in Belgian Patent Specification No. 828,368.

One of these problems is that when the film carrying the developed image is separated from its support, the toner particles which are not yet fixed are shifted by electric forces in the powerful leakage fields produced by the separating process, with the result that smears are formed in the image. Furthermore, the electrical contact between an insulating film and a flat, metallically conductive support is so imperfect that faults occur in development and the quality necessary for a half tone image is not obtained.

Since electrographic processes are mainly rapid processes, relatively little time is available in the development section of a continuously operating recording and development process for the necessary contact of the back of the recording carrier with the support. It is therefore technically impossible to use lengthy procedures to ensure contact, such as application of the carrier film to a metal plate by suction obtained by the evacuation of the gap or vapour application with a metal layer.

Better solutions to the problem of contact have been described, for example, in British Patent Specification No. 1,397,650. In this case, the back of the recording carrier is wetted with electrically conductive liquids so that the carrier is covered with a conductive layer which ensures uninterrupted contact with the support.

On separation of the recording carrier from the support after development of the image, the back of the carrier at first remains wetted with liquid so that it is sufficiently conductive to prevent blurring of the image by electric forces.

When a recording carrier in the form of a continuous strip is used for continuous operation, however, disadvantages still arise. Thus, an excessive amount of additional apparatus is required for the pumping device, the applicator device for the contact liquid and other devices for removal of the contact liquid from the recording carrier after passage of the carrier through the development zone.

It is therefore an object of this invention to avoid the need for these complicated devices by providing an improved method of producing contact.

According to the invention, there is provided a process for improving the electrical contact between an insulating image carrier and a conductive support during an electrographic development process, in which a latent electrostatic charge image is rendered visible on the insulating image carrier by means of charged pigment particles, wherein a gas permeable electrically conductive support is used, through which gas ions are brought to the back of the carrier while development takes place on the image side.

According to the invention, the surface on which the insulating recording carrier is placed during development of the latent charge image is that of a gas permeable, electrically conductive support in the form of a thin layer of dimensionally stable material, and ionised gas is brought to the exposed side of this layer, gas ions passing through the gas permeable layer to the back of the recording carrier. For practical reasons, for example for better support and guidance of a recording carrier in the form of a strip or for firmer adherence of individual samples, the recording carrier may be pressed to its support by reduction of the pressure at the interface between them. However, direct physical contact is in principle unnecessary if the electric contact is produced by gas ions in accordance with the invention. However, it is essential to provide a conductive, gas permeable layer between the source of ions and the recording carrier because it is only this layer which can provide the necessary potential for development of the image. In the absence of this intermediate layer, the back of the recording carrier would become charged in a completely random manner and in the extreme case the image surface would be completely blackened instead of a visible image being produced thereon.

The gas used for contact may generally be air but in special cases it may be advantageous to use a gas having a lower electron affinity, for example nitrogen or one of the inert gases.

The gas permeable layer may consist of a wire gauze or sieve netting of conductive material. The mesh count may be in the region of 100 to 50,000 meshes per $cm^2$.

The polarity of the gas ions is selected so that the charge of the ions is opposite in sign to the charged pigment particles used for development of the charge image. For example, if a charge image consisting of negative charges is to be rendered visible on the recording carrier by positive pigment particles, the gas ions brought to the back of the recording carrier through the support must be negatively charged. The developers commonly used in the field of electrophotography or electrography may be used for developing the charge images in the process according to the invention. Developers of this kind have been described in detail in "Electrophotography" published by R. M. Schaffert, The Focal Press, London, New York, in the section "Image Development".

The process according to the invention will now be explained with reference to its use with a so-called liquid developer.

The process is illustrated in FIGS. 1 and 2 of the accompanying drawings.

FIG. 1 shows an apparatus for image development, using a liquid developer in a fluidised bed and a point corona for production of the ions.

Figure 2A:
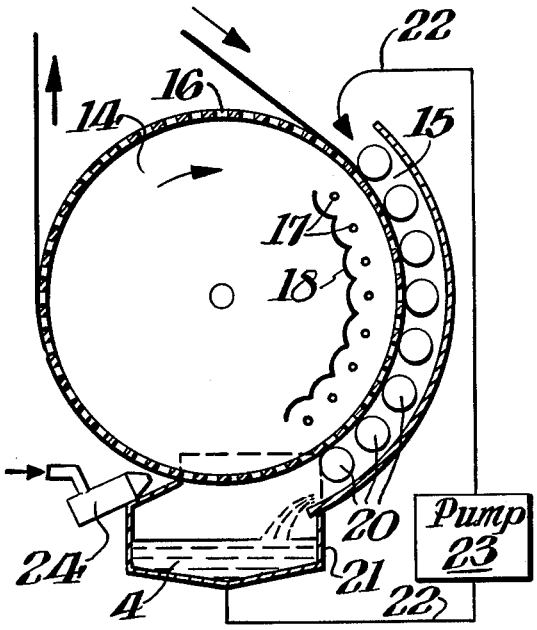
Figure 2B:
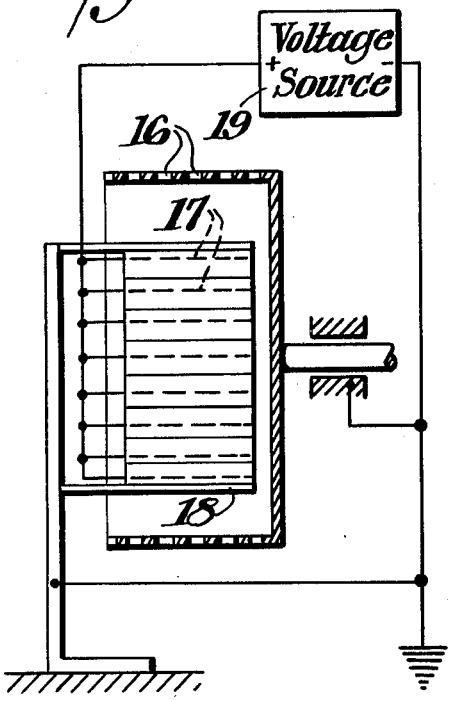

FIGS. 2*a* and 2*b* show an apparatus for a recording carrier in the form of a continuous strip, wherein liquid developer flows over applicator rollers and the gas ions are produced in an assembly of electric discharge wires.

According to FIG. 1, a recording carrier 1 consisting of an insulating film, e.g. a polycarbonate film, is held to a grid electrode 3 by a slight vacuum in a discharge chamber 2. It is placed with its image side downwards and is washed by liquid developer 4. The vacuum in the discharge chamber 2 is produced by a ventilator 5 which sucks air out of the discharge chamber 2 through a pipe 6. Gas ions produced by a corona discharge on a point electrode 7 move from the point to the grid electrode 3 and to the wall of the discharge chamber 2, where they are discharged. Some of these ions pass through the meshes of the grid electrode 3 and neutralise those areas of the recording carrier which during the development process assume potential values different from that of the grid electrode 3. The point electrode 7 is insulated from the conductive wall of the discharge chamber 2 by an insulator 8 and is connected to the voltage source 9 which supplies a direct voltage of several kilovolts. A fluidised bed for liquid developer is shown in the lower part of the drawing. It is formed by feed pipes 10, a metal grid 11 and a funnel-shaped liquid container 12. To ensure uniform supply to the development zone, the liquid 4 must be kept in circulation from a storage vessel via a pump system (not shown in the drawing) to the development area and back. In the development zone, liquid is delivered from slots 13 on the upper surfaces of the feed pipes 10 and flows through the metal grid 11 to flush the recording carrier 1. It then returns partly over the marginal zones of the liquid container and partly through the gaps between the feed pipes 10 to be discharged through the constriction forming the lower part of the funnel-shaped container 12. In this way an electrostatic image can be rendered visible on the recording carrier 1 within a dwelling time of, say, 1 to 2 seconds in the development chamber. This apparatus can be used not only for development on a recording carrier which is temporarily stationary but also for development of an image on a recording strip continuously moving through the development zone.

An apparatus particularly suitable for recording carriers in the form of continuously moving strips is that shown in FIG. 2, in which the recording carrier 1 is wrapped over a rotating guide drum 14 and moved with the drum through a development zone 15. In this case the support for the recording strip is a metal grid 16. The stream of ions required for complete contact between the recording carrier 1 and metal grip 16 is produced by an arrangement of electric discharge wires 17 in front of a screen electrode 18. The discharge wires are connected by a voltage source 19 which maintains the necessary voltage between the electric discharge wires and screen electrodes for the production of the corona discharge current. For development of the image, the liquid developer 4 is pumped from container 21 into the development zone 15 by way of a pipe 22. In this development zone, the developer liquid is brought into intimate contact with the surface of the image carrier by means of rotating applicator rollers 20 before it flows back into the container 21. A pump 23 is used to maintain the circulation of liquid developer. For removal of the layer of liquid developer carried on the moving recording carrier, an air jet nozzle 21 is arranged behind the container 4 so that a sharp blast of air from the nozzle forces most of the layer of liquid back into the container, and the image carrier therefore leaves the development zone in a state in which it has been subjected to a preliminary drying.

The method of providing contact for the back of the recording carrier by means of gas ions does not restrict the process to the use of liquid developers. Aerosols and developers in the form of powders can be used in similar manner.

The method of providing contact by means of ions is applicable wherever electrostatic charge images are required to be developed on low conductivity or non-conductive carrier material.

We claim:

1. In a continuously operating electrographic recording and development process for producing in a development zone an electrostatic charge image on an image carrier consisting essentially of a highly insulating film and particles thereon the steps comprising imposing a latent electrostatic charge image on one surface of a continuous strip of a highly insulating film subsequently introducing said charged insulating film into an image developing step during which developing step said insulating film separates a first zone where developer fluid is in contact with the charged image side of the film from gaseous ions and a gas permeable electrically conductive grid positioned in a second zone on the opposite side of the film, in said first zone flowing a fluid developer comprised of a non-conductive fluid and charged pigment particles across said surface having the latent electrostatic charge image, and developing a visible image on said surface by means of the particles during a dwelling time of said film in said development step in said first zone in the range of 1 to 2 seconds electrically contacting the opposite side of the film from the imaged surface against the gas permeable electrically conductive metal grid during the dwelling time and while flowing of the developer in contact with the imaged surface, producing said gaseous ions by corona discharge adjacent to but removed from said conductive support and passing a portion of said gaseous ions through the metal grid and into direct contact with the surface of said opposite side of said film, said gaseous ions in direct contact with said opposite surface forming electric contact, said contact being dry and in the absence of a liquid, the polarity of said ions being opposite to the sign of said charged pigment particles, producing constant potential on said opposite side of the film by means of the metal grid and the gaseous ions, whereby the visible image on the film imaged surface is defined.

2. A process as claimed in claim 1 wherein discharge electrode points under an electrical potential produce said gaseous ions.

3. A process according to claim 2, characterised in that said discharge electrode points are wires.

4. A process as claimed in claim 2 wherein said electrical potential is a d.c. voltage and the gaseous ions are opposite in polarity to that of the charged pigment particles.

5. The process as claimed in claim 1 wherein the atmospheric pressure is reduced on the insulating film at said other surface and said other surface is pressed against the gaseous permeable electrically conductive support.

* * * * *